United States Patent [19]

Newcomb et al.

[11] 4,002,893

[45] Jan. 11, 1977

[54] ILLUMINATED PLAYBALL

[76] Inventors: Nelson F. Newcomb; Nelson F. Newcomb, Jr., both of Mirror Lake, N.H. 03853

[22] Filed: Oct. 6, 1975

[21] Appl. No.: 620,011

[52] U.S. Cl. ..... 240/6.4 R; 46/228

[51] Int. Cl.[2] ..... F21V 33/00; A63H 33/26

[58] Field of Search ..... 240/2 G, 6.4 R; 46/228; 273/58 G

[56] References Cited

UNITED STATES PATENTS

| | | | |
|---|---|---|---|
| 2,307,362 | 1/1943 | Dupler | 240/2 G |
| 2,660,661 | 11/1953 | Dupler | 240/2 G |
| 2,780,029 | 2/1957 | Anthony | 46/111 |
| 2,849,819 | 9/1958 | Murphy et al. | 240/6.4 R X |
| 3,011,048 | 11/1961 | O'Brien | 240/6.4 R |
| 3,229,976 | 1/1966 | Allen, Jr. | 240/6.4 R X |
| 3,304,651 | 2/1967 | Deyerl | 240/6.4 R X |
| 3,610,916 | 10/1971 | Meehan | 46/228 X |
| 3,786,246 | 1/1974 | Johnson et al. | 46/228 X |
| 3,798,834 | 3/1974 | Samuel | 46/228 |
| 3,804,411 | 4/1974 | Hendry | 46/228 X |

*Primary Examiner*—Donald A. Griffin
*Attorney, Agent, or Firm*—C. Yardley Chittick

[57] ABSTRACT

The invention comprises a hollow self-supporting ball, in the form of a football, basketball, volleyball, etc. made of translucent plastic material and having an internal source of illumination of such intensity that the ball may be used in the dark. A battery powered light source is mounted within the ball in a novel manner which permits ready removal from and re-insertion into the ball for actuating the light switch and replacement of batteries when necessary.

10 Claims, 6 Drawing Figures

ILLUMINATED PLAYBALL

FIELD OF THE INVENTION

The concept of providing interior illumination for playballs so that the balls may be thrown and caught in the dark has been known for many years. See the United States Patents to Hendry U.S. Pat. No. 3,804,411, Samuel U.S. Pat. No. 3,798,834, Johnson et al. U.S. Pat. No. 3,786,246, Meehan U.S. Pat. No. 3,610,916, Deyerl U.S. Pat. No. 3,304,651, Allen, Jr. U.S. Pat. No. 3,229,976, O'Brien U.S. Pat. No. 3,011,048, Murphy et al. U.S. Pat. No. 2,849,819, and Anthony U.S. Pat. No. 2,780,029.

All of these balls and other lighted play units have generally been made of translucent material so that the lighting sources associated therewith are able to provide sufficient general illumination permitting them to be thrown and caught in the dark. As far as we are aware however, none of the devices of the prior art have been commercially marketed because of expensive, complicated constructions and the inability of the lighting structures mounted within to withstand for long the rough handling and high acceleration and decleration to which balls are subjected when they are thrown, caught, kicked, or bounced on the ground.

SUMMARY OF THE INVENTION

The present invention utilizing a ball preferably made of translucent plastic but not limited thereto resides primarily in the provision of means whereby a light source and its supporting structure may be inserted into the translucent ball through a specially located hole in the ball wall and held securely therein without the need for permanent connection with the ball. When the ball is to be used in the dark, the light supporting structure may be readily removed so that the light may be turned on and the structure then replaced within the ball. Similarly, after use the light supporting structure may easily be removed and the light turned off. The construction also provides for the ready removal and replacement when necessary of the batteries that supply the power for the electric light.

The invention also contemplates the use of translucent plastic material forming the wall of the ball which is of sufficient thickness and rigidity to provide a self-supporting ball that does not have to be inflated to maintain its normal configuration. On the other hand, the material forming the ball wall has a sufficient degree of flexibility and elasticity to be stretched and/or distorted enough to permit the entry through the special access hole of the light supporting tube to a position in the ball where it will be held firmly in place in diametrically opposite sockets formed in the interior of the ball.

It is to be understood that when the term "ball" is used herein it includes not only spherical balls similar in size to basketballs, baseballs, softballs, soccer balls, volley balls, etc. but also those of spheroidal form such as the conventional football.

A preferred form of the invention is found in the football type in which the light supporting means may be located and mounted within the ball along the long axis. To increase visibility, it may be considered desirable to have a plurality of perforations preferably uniformly spaced around the surface of the ball so that the interior light may shine directly through these holes. This direct light coupled with the more than adequate visibility provided by the translucent nature of the ball wall adds to the illumination and may be thought to increase the attractiveness of the unit when in flight in the dark.

The supporting structure for the electric light is preferably a relatively rigid tube of translucent plastic with an interior diameter large enough to receive a pencil type commercially available lighting unit along with axially aligned cushioning springs which hold the lighting unit in position in the tube. The remote ends of the springs engage the plugs which close the ends of the light supporting tube or if the plugs are omitted, the springs will engage the sockets in which the tube ends reside.

Another important feature of the invention in the preferred form is the provision of a second hold in the wall of the ball opposite the access hole through which the lighting structure is inserted into the ball. This second hole is large enough to permit the insertion of a person's thumb or finger so that he may press with sufficient force against the light supporting tube to dislodge the tube from its socket and to force the end of the tube into the first hole through which the supporting structure may be withdrawn. In the construction in which the ball wall is sufficiently flexible to permit outside pressure to be brought to bear against the side of the light tube, the second finger hole may be omitted.

DESCRIPTION OF A PREFERRED EMBODIMENT

Figure 1:
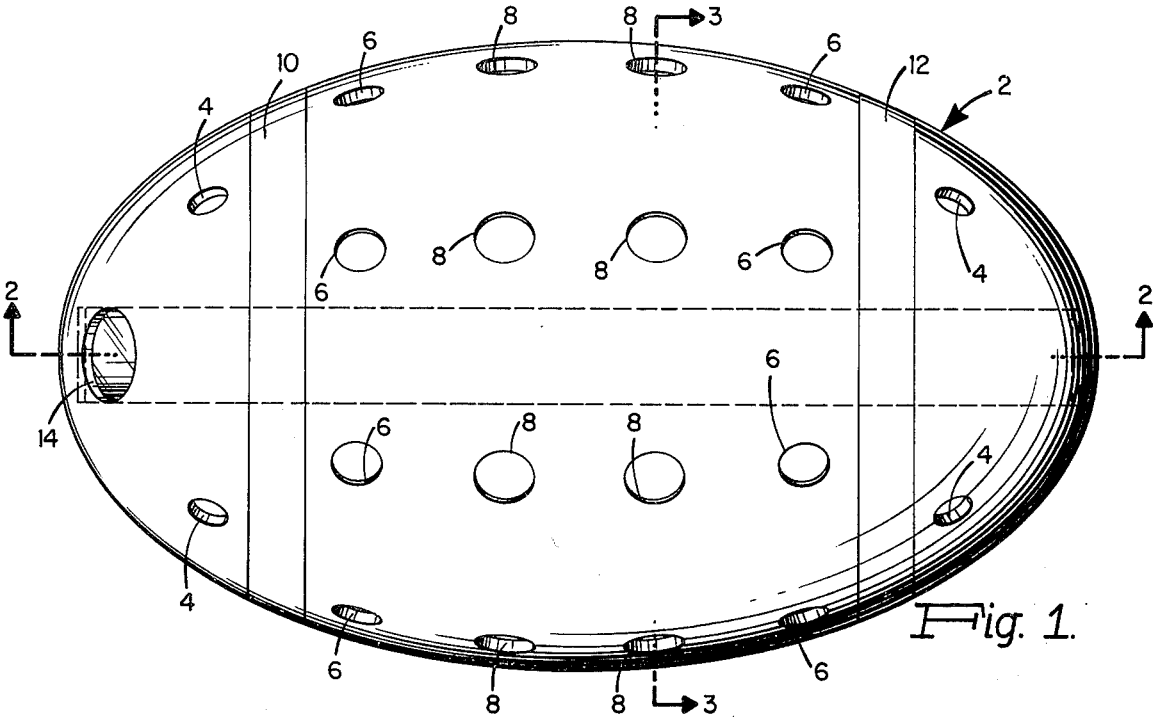
FIG. 1 is a side elevation of an illuminated ball having the shape of a conventional football.
Figure 2:
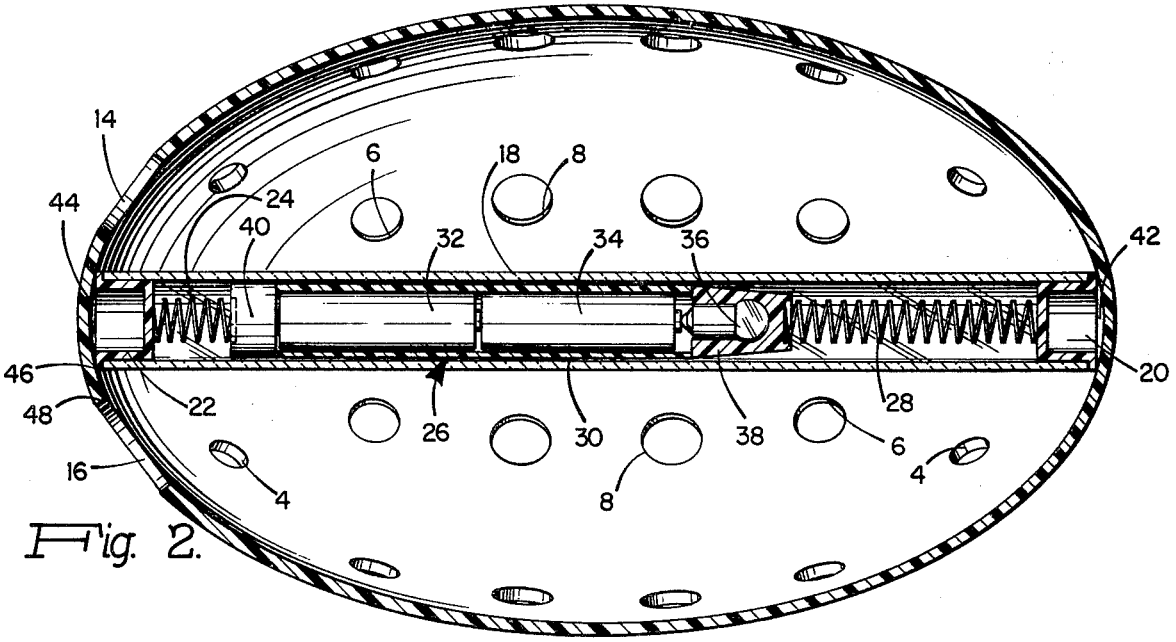
FIG. 2 is a section taken on the line 2—2 of FIG. 1.
Figure 4:
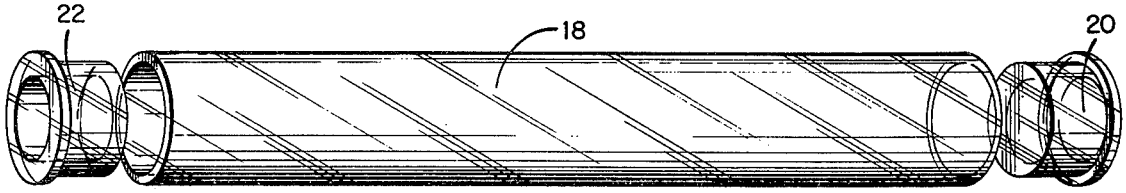
FIG. 4 is an exploded view of the light supporting tube with the end closures removed.
Figure 3:
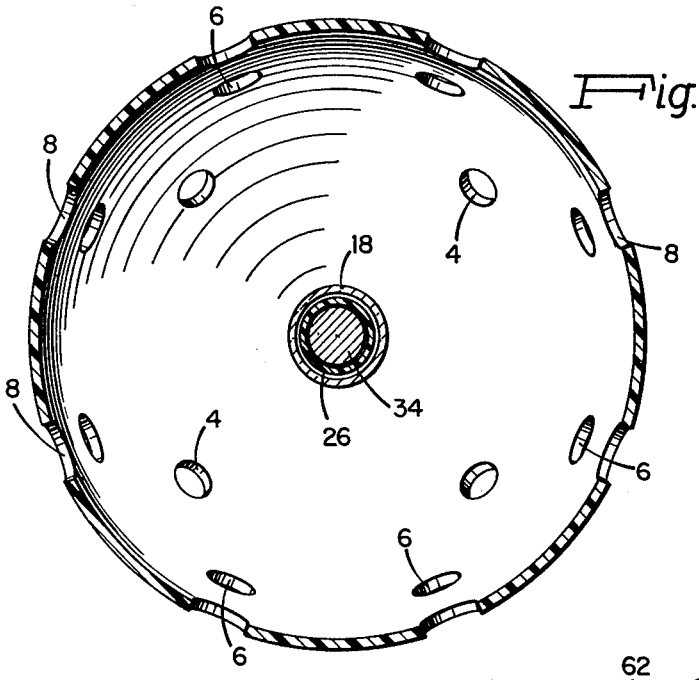
FIG. 3 is a section taken on the line 3—3 of FIG. 1.

In the preferred form, the ball with which the lighting device is used will be in the shape of a spheroid as shown in FIGS. 1 and 2. This ball has substantially the same exterior configuration as the commomly used leather covered football.

The ball generally referred to at 2 is approximately 10 inches long and 6 inches in diameter. The wall is made preferably of polyethylene in sheet form about three thirty-seconds of an inch thick and rigid enough to be capable of being handled and thrown without appreciable deformation. In the manufacture of these balls it is customary to mold them in two halves and then secure the halves together about the circumferential line.

The polyethylene wall is quite translucent so that it is easily illuminated by an interior light source. Since the unit is made by molding two halves, the halves may be made of different colors thereby to increase the attractivness of the finished ball.

As shown in FIGS. 1 and 2, the ball in a preferred form has a plurality of small circular openings through the wall. At the ends there are four openings 4 spaced 90° apart. Inwardly thereof, there are two other sets of openings 6, which are spaced 45° apart and toward the center there are still two other sets of openings 8, also spaced 45° apart. Colored bands such as are indicated at 10 and 12 may be painted on or otherwise applied to the outer surface to further increase the similarity to a real football.

At one end of the ball are two larger openings 14 and 16, one of which is at least large enough to receive a light supporting tube 18, which is shown in section in FIG. 2. This tube preferably is made of translucent polyethlene capable of transmitting light effectively. The tube however could be of transparent plastic. The ends of the tube may be closed by a pair of hat-like plugs 20 and 22, which fit sufficiently tightly within the ends of the tube to render the interior water tight.

Within the tube is a first compression spring 24, a light unit 26, and a second, longer compression spring. The light unit 26, has a cylindrical housing 30 within which are a pair of batteries 32 and 34 which supply current for an electric bulb 36 located within a traslucent end piece 38. A rotary switch 40 serves to turn the bulb 36 on or off.

When the parts are assembled as shown in FIG. 2, the light unit 26 is sufficiently supported endwise by the springs 24 and 28, and laterally by the tube 18 to be substantially immune from damage or broken circuitry during all normal use to which the ball might be put such as throwing, catching, kicking and bouncing.

The tube 36, in a preferred form may be about seven-eighths inches outside diameter and three-fourths inches inside diameter giving a wall thickness of one-sixteenth inch. This presents a substantially rigid, non-compressible tube, both axially and crosswise. However, because of the inherent properties of polyethylene the tube is bendable to a degree when sufficient manual force is applied.

Because of the spheroid configurartion of the ball, the concave areas indicated at 42 and 44 present socket formations which are adapted to receive the ends of the closed tube 18. The parts are accurately dimensioned so that when the closed tube is within the ball as shown in FIG. 2 the periphery of plug 20 will rest firmly against the circular inner wall of socket 42 and the periphery of plug 22 will likewise be in firm engagement with the inner wall of socket 44. In this condition, the tube 18 will be under some axial compression and the wall of the ball will be under corresponding tension. Thus the tube 18, containing the protected lighting unit 26 and closed at its ends by plugs 20 and 22, will when accurately dimensioned with respect to the ball 2, be firmly anchored in place under all conditions of play. It will be noted that there are no permanent attachments between the ends of tube 18 and the ball interior so that the tube may at will be inserted and removed from the ball without any change in the ball structure.

Where it has been found unnecessary to make the tube 18 water tight or moisture proof, the plugs 20 and 22 may be omitted. In such case, the tube 18 will be lengthened to have its ends engage the sockets and the springs 24 and 26 will press against the socket surfaces.

The removal of tube 18 from the ball is accomplished by shifting the end of tube 18 from its position in socket 44 into the slightly larger access hole 16. With this accomplished, the tube 18 and its contents may be withdrawn from the ball.

In order to get the end of tube 18 out of socket 44 and into the hole 16, it is necessary that the wall of the ball be of sufficient elasticity and distortability so that the user by pressing his thumb against tube 18 through opening 14 and simultaneously distorting the ball wall with the other hand can move the edge 46 of plug 22 past the edge 48 of hole 16. Once these two edges have passsed each other, the end of the tube may then be readily moved the rest of the distance until it is fully within the confines of access hole 16. Then the tube can be freely withdrawn from the ball.

The principal reason for removal of tube 18 from the ball is to enable the switch 40 to be actuated to turn the light 36 on or off according to the user's wishes. This is accomplished by removing plug 22 from the end of the tube after which, by turning the tube vertically, the spring 24, lighting unit 26 and spring 28 will slide down and out of the tube. The switch 40 is then actuated and the parts replaced in the tube in the same order and the end is then closed by plug 22. The tube is then reinserted in the ball following reverse procedures in which the leading end of the tube is placed in socket 42 and then the other end of the tube is worked past the lip of hole 16 so that the other end can then spring into socket 44.

When the light 36 is on, the volumn of light emitted therefrom brightly illuminates the translucent or transparent tube 18 and this light in turn illuminates the entire wall of the ball 2 from end to end and about its entire circumference and including the small end areas forming the sockets 42 and 44.

The ability to remove the tube 18 from the ball to turn the switch or or off, to replace the batteries or the bulb if necessary and then to be able to replace the tube within the ball, all done easily without the use of tools, is an important feature of the invention. When in position within the ball, the tube is always securely held in its axial location. The two holes 14 and 16, larger than the other holes 4,6 and 8 do not adversely affect the general appearance of the ball or its symmetry or balance.

The center of gravity of the assembled lighting structure and the supporting tube does not have to be at the mid-point of the ball axis. It has been found in practice that the center of gravity may be some distance either side of the midpoint without appreciably affecting the flight of the ball whether it be thrown spirally or end over end.

It will also be noted that the light bulb 36 is not at the mid-point of tube 18. It has been found that the eccentrically positioned light is diffused along the length of the tube 18 and further diffused over the entire length of the ball. Thus, when the ball is illuminated and viewed in the dark the ball appears to be substantially uniformly lighted over its entire surface.

Figure 5:
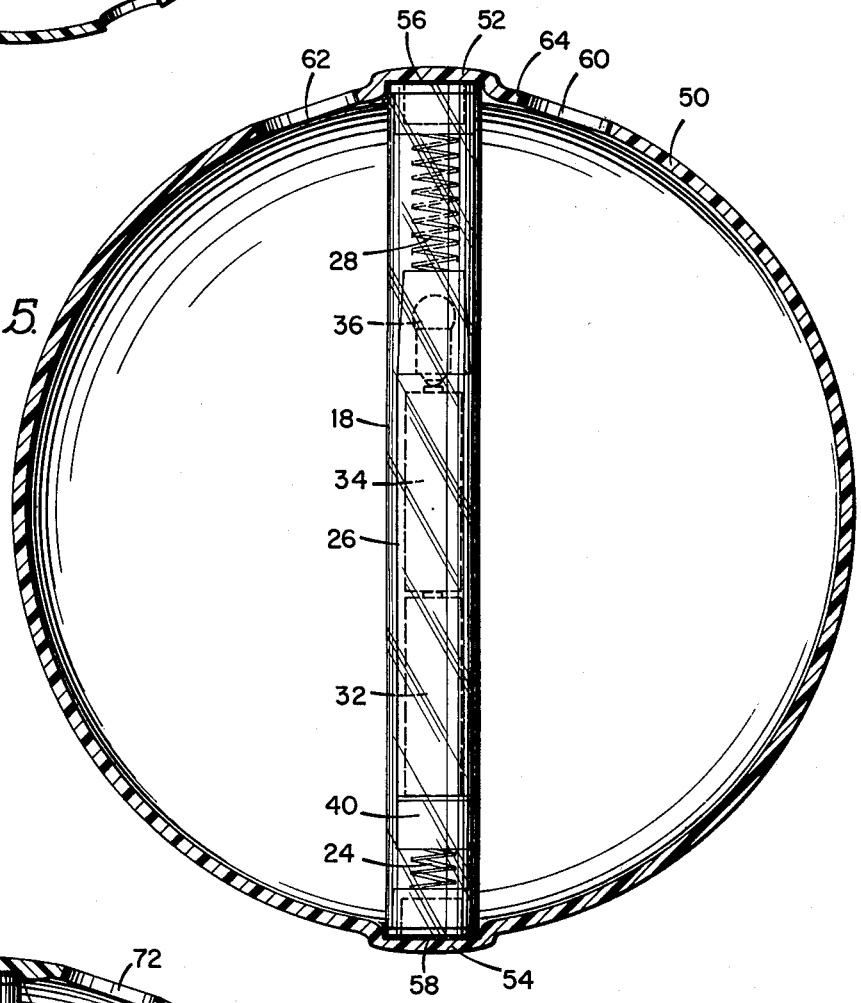
FIG. 5 shows a modification in which the light supporting structure is mounted in a spherical ball.

A modification is shown in FIG. 5. Here the ball instead of being a spheroid is more or less spherical. The wall 50 is preferably made of polyethylene or any other type of translucent plastic having sufficient inherent strength to maintain its form under the normal use to which such ball will be put. In FIG. 5, the tube 18 is the same as that shown in FIG. 1 and contains the lighting source 26 and the supporting springs 24 and 28.

The sockets in which the ends of the tube 18 reside are made by forming outwardly extending low mounds 52 and 54 which create corresponding interior sockets 56 and 58. Immediately adjacent one end of tube 18 are a pair of openings 60 and 62, disposed 180° apart. These openings are of such size that the user's thumb may enter one opening to push the end of tube 18 toward the other opening which is large enough to permit the withdrawal of the tube when the end of the tube has been disposed therein. The parts are very accurately dimensioned so that in use the tube 18 will not become dislodged from sockets 56 and 58. However, because of the flexibility and elasticity of the material forming wall 50 and tube 18, the end of the tube can be manually forced past the lip 64 of hole 60 and then on the rest of the way into the hole 60, thus to permit withdrawal of the tube and disassembly of the parts to permit actuation of the switch 40 or replacement or recharging of batteries 32 and 34 or replacement of the electric bulb 36 should it burn out. When the lighting source and tube are in order and reassembled, the tube 18 may then be returned to position within sockets 56 and 58.

Figure 6:
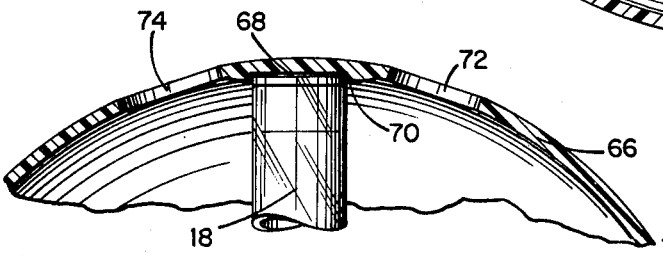
FIG. 6 is another modification showing another type of socket used in a spherical ball for securing the ends of the light supporting tube.

Still another modification is shown in fragmentary section in FIG. 6 in which the wall 66 of the spherical ball does not have any outward protuberances such as the bumps 52 and 54 shown in FIG. 5. Instead, on the interior there is a very shallow socket 68, having a very low circular wall adequate to keep the ends of tube 18 in place during normal use, but still permitting the end of the tube to be pushed into opening 72 by the force of a user's finger entering through opening 74.

It is to be understood from all of the disclosures that the diametrically oppositely positioned sockets into which the ends of tube 18 are positioned will be deep enough to hold the tube 18 securely in position during all normal use of the ball. At the same time however, the two holes adjacent the end of the tube must be located close enough to the socket so that the end of tube 18 can always be manually dislodged to enter the tube access hole. The flexibility of tube 18 and the flexibility and elasticity of the wall material of the ball all must be considered in determining the exact location of the tube access hole and the finger access hole.

While generally it is considered desirable to have the access holes adjacent one end only of the light supporting tube 18 it will also be apparent that a second set of similar holes could be formed in the ball wall adjacent the other end of the tube. The extra holes would be unnecessary for removal or insertion of tube 18, but might be preferred to improve visual symmetry.

MODIFICATIONS

In the preferred form heretofore described, the ball wall is made of a translucent plastic with or without additional small holes through the wall. It has been found that this construction gives very acceptable lighting characteristics. However it is to be understood that alternative wall constructions can be used without departing from the invention. For example, the ball wall could be made of opaque sheet material, not necessarily of flexibility and elasticity and including a sufficient number of holes therethrough, such as the holes 4, 6 and 8 to permit adequate emission of light therefrom for use of the ball in the dark. Another modification is that in which the ball wall is of transparent material. The tube 18 in the preferred form is made of translucent or transparent plastic but the tube could also be made of tempered or safety glass or thin adequately perforated metal. The basic requirement is the distribution of sufficient light from the light source to illuminate the ball wall whatever the wall construction may be, whether, as set forth above, of material that is translucent, translucent with holes, transparent, transparent with holes, opaque with holes or any combination of the above.

In all cases, the ends of tube 18 will be firmly held in the opposed sockets even though there is no permanent connection between the ball and the tube.

Another alternative falling within the scope of the invention should be mentioned. If the wall of the ball were sufficiently flexible, the finger access hole may be omitted because it would then be possible to distort the wall inwardly far enough to engage the tube to force it sidewise into the access hole.

When the wall of the ball is too stiff to be deflected enough to push the tube into the access hole, the tube end can be moved from its socket to the access hole by utilizing a hook inserted through the hole and placed around the tube enabling the tube end to be pulled from the socket to the hole.

When the term "translucent plastic" is used in the claims it is to be understood that the other ball wall materials referred to above are to be considered the equivalent thereof in measuring the scope of the invention.

The above disclosure will suggest to others skilled in the art modifications which are within the scope of the invention as defined by the appended claims.

We claim:

1. A hollow ball having a self-supporting wall made of translucent plastic, first and second diametrically oppositely disposed sockets in the said ball, a light transmitting self-supporting tube containing a light source and having its ends in said sockets, a first hole in said wall closely adjacent the first of said sockets and large enough to permit passage of said tube therethrough.

said wall and said tube together capable of sufficient distortion to permit the moving of one end of said tube from its position in said first socket to a position in said first hole whereby said tube and light source may be withdrawn from said ball.

2. The construction set forth in claim 1, the length of said tube with respect to the location of said first hole being such that distortion of the periphery of said first hole is also necessary to effect insertion of the tube end into said first hole.

3. The construction set forth in claim 1, and a second hole in said wall also adjacent the end of said tube whereby a person's finger can be inserted in said second hole to exert pressure against said tube in a direction toward said first hole.

4. The construction set forth in claim 1, the distance between said first hole and the remote socket being less than the distance between said sockets.

5. The construction set forth in claim 1, said tube having closures at both ends, said light source within said tube comprising a holder for batteries and an electric light bulb and circuitry permitting said light source to be turned off and on and compression springs holding said light source in an intermediate position between said closures.

6. The construction set forth in claim 1, said light source being held in position within said tube by compression springs disposed at opposite ends of said light source, the remote ends of said springs exerting a force against the ball wall.

7. The construction set forth in claim 1, said ball being in the form of a spheroid and said sockets being at the ends of the longitudinal axis of said spheroid.

8. The construction set forth in claim 1, said ball being spherical and said sockets being formed by the interior areas of diametrically opposite raised portions of said ball wall.

9. The construction set forth in claim 1, said ball having a plurality of other holes through its wall symmetrically arranged about the ball surface, said other holes all being smaller than said first hole whereby light coming from said light source and tube may shine unimpeded through said other holes.

10. An illuminated playball comprising a hollow unit whose exterior size and shape is substantially that of a conventional football, said playball having its wall made of translucent plastic sheet material rigid enough to maintain its shape when being normally handled or thrown but capable of distortion under increased manual pressure, the concave interior ends of said playball forming sockets, a self-supporting plastic translucent tube containing a light source and positioned within said playball and having its ends in said sockets, whereby said tube and light source therein will be maintained in position within said playball under all normal playing conditions to which the playball will be subjected, first and second holes through said wall closely adjacent one end of said tube, the said first hole being large enough to receive said tube, the said second hole being at least large enough to permit the insertion of a person's finger, said playball and tube together being capable of sufficient distortion so that the end of the tube adjacent said holes can be manually moved by force applied through said second hole, from its socket to said first hole whereby the tube can be removed from said playball and conversely, whereby said tube can be replaced in said playball by insertion through said first hole to place the leading end of the tube in the remote socket and by manual distortion of said tube and/or wall of said playball, the rear end of said tube can be forced past the edge of said first hole to move into secure engagement within its related socket.

* * * * *